United States Patent [19]

Meyer

[11] Patent Number: 4,908,539

[45] Date of Patent: Mar. 13, 1990

[54] DISPLAY UNIT BY CATHODOLUMINESCENCE EXCITED BY FIELD EMISSION

[75] Inventor: Robert Meyer, Saint Ismier, France

[73] Assignee: Commissariat A l'Energie Atomique, France

[21] Appl. No.: 177,880

[22] Filed: Mar. 24, 1988

Related U.S. Application Data

[63] Continuation of Ser. No. 758,737, Jul. 25, 1985, abandoned.

[30] Foreign Application Priority Data

Jul. 24, 1984 [FR] France ..... 84 11986

[51] Int. Cl.[4] ..... G09G 3/10

[52] U.S. Cl. ..... 315/169.3; 315/169.4; 315/169.1

[58] Field of Search ..... 313/309, 336, 351, 109; 315/169.3, 169.4

[56] References Cited

U.S. PATENT DOCUMENTS

| | | | |
|---|---|---|---|
| 2,926,286 | 2/1960 | Skellett | 315/169 |
| 3,500,102 | 3/1970 | Crost et al. | 313/109 |
| 3,581,148 | 5/1971 | Brignet | 313/309 |
| 3,622,828 | 11/1971 | Zinn | 313/67 |
| 3,634,714 | 1/1972 | Anderson | 315/169.3 |
| 3,755,704 | 8/1973 | Spindt et al. | 313/309 |
| 3,855,499 | 12/1974 | Yamada et al. | 315/169 R |
| 3,921,022 | 11/1975 | Levine | 313/109 |
| 3,998,678 | 12/1976 | Fukase et al. | 313/309 |
| 4,020,381 | 4/1977 | Oess et al. | 313/309 |
| 4,149,147 | 4/1979 | Kishino | 315/169.3 |
| 4,178,531 | 12/1979 | Alig | 313/309 |
| 4,459,514 | 7/1984 | Morimoto et al. | 315/169.1 |
| 4,513,308 | 4/1985 | Greene et al. | 313/309 |
| 4,575,765 | 3/1986 | Hirt | 315/169.3 |
| 4,763,187 | 8/1988 | Biberian | 358/56 |

FOREIGN PATENT DOCUMENTS

| | | | |
|---|---|---|---|
| 2437661 | 4/1980 | France . | |
| 2443085 | 6/1980 | France . | |
| 121454 | 10/1978 | Japan | 313/309 |

*Primary Examiner*—Leo H. Boudreau
*Assistant Examiner*—Michael Razavi

[57] ABSTRACT

Display unit by cathodoluminescence excited by field emission.

It comprises a plurality of elimentary patterns, each having a cathodoluminescent anode and a cathode able to emit electrons. Each cathode comprises a plurality of electrically interconnected micropoints subject to electron emission by field effect when the cathode is negatively polarized compared with the corresponding anode, the electrons striking the latter, which is then subject to a light emission. Each anode is integrated to the corresponding cathode.

Application to the display of stationary or moving pictures.

8 Claims, 3 Drawing Sheets

DISPLAY UNIT BY CATHODOLUMINESCENCE EXCITED BY FIELD EMISSION

This application is a continuation of application Ser. No. 758,737, filed Jul. 25, 1985, now abandoned.

BACKGROUND OF THE INVENTION

The present invention relates to a display unit by cathodoluminescence excited by field emission. It more particularly applies to the production of simple displays, permitting the display of fixed images or pictures, and to the production of complex multiplexed screens, making it possible to display moving pictures, such as television pictures.

Cathodoluminescence display units are already known, which use a thermoelectronic emission. A particular construction of such units is diagrammatically represented in FIG. 1 and comprises a plurality of anodes coated with a cathodoluminescent substance or phosphor 2 and arranged in parallel lines on an insulating support 4, together with a plurality of filaments 6 able to emit electrons when heated and which act as cathodes, said filaments being arranged along lines parallel to the anodes. A plurality of grids 8 are placed between the anodes and the filaments, being arranged in parallel columns and the latter are perpendicular to the lines or rows. The assembly constituted by the anodes, the filaments and the grids are exposed or bared in a transparent box or casing 10, which is sealingly connected to support 4. When heated, the filaments 6 emit electrons and an appropriate polarization of a filament, grid and anode enable the electrons emitted by said filament to strike the anode, which is then subject to light emission. By matrix addressing of the rows of anodes and columns of grids, it is in this way possible to produce images or pictures, which are visible through the transparent casing 10.

Such display units suffer from the disadvantages of the definition of the images which they make it possible to obtain not being of a high quality, the devices or units are complicated to produce and they have a high electric power consumption, in view of the fact that the filaments have to be heated.

The principle of electronic emission by field effect is also known, which is also called "field emission" or "cold emission". This principle has already been used for applications unlinked with visual display. It is diagrammatically illustrated in FIG. 2 where, in a vacuum, metal points 12 serving as cathodes and placed on a support 14, are able to emit electrons when an appropriate voltage is established between them and an anode 6 positioned facing said points.

SUMMARY OF THE INVENTION

The object of the present invention is to obviate the aforementioned disadvantages by proposing a display unit utilizing field emission, whose principle has been given hereinbefore.

Specifically, the present invention relates to a display unit comprising a plurality of elementary patterns, each having a cathodoluminescent anode and a cathode able to emit electrons, wherein each cathode comprises a plurality of electrically interconnected micropoints and subject to an electron emission by field effect when the cathode is negatively polarized relative to the corresponding anode, said electrons striking the latter, which is then subject to a light emission. Each anode can be integrated to the corresponding cathode and electrically insulated therefrom.

In fact, electron emission is only high above a certain polarization threshold and below it, emission is low and then only leads to a small amount of light being produced.

In this way it is possible to obtain an overall light image by appropriately polarizing the elementary patterns. When the different polarizations are maintained constant over a period of time, the image obtained is fixed, but it is also possible to obtain moving images or pictures, by varying in an appropriate manner the polarizations during a period of time.

The present invention makes it possible to obtain flat screens operating under a low voltage, in the same way as the known units referred to hereinbefore. However, the pictures obtained by means of the unit according to the invention have a much better definition. Thus, it is possible to produce very small micropoints, at a rate of a few tens of thousands of micropoints per square millimeter, which makes it possible to produce elementary cathodes having a very small surface and consequently it is possible to excite very small cathodoluminescent anodes.

In addition, the unit according to the invention has a much lower electric power consumption than the aforementioned Prior Art units, in view of the fact that it uses cold cathodes.

The surface of the cathode corresponding to an elementary pattern can either be equal to or less than the surface of the anode of said pattern. As it is possible to produce a large number of micropoints per square millimeter, it is possible to excite each anode by a very large number of micropoints. The light emission of an elementary pattern corresponds to the mean emission characteristic of all the corresponding micropoints. If a small number of micropoints do not function, this mean characteristic remains substantially unchanged, which constitutes an important advantage of the invention.

According to a special embodiment of the unit according to the invention, the latter also comprises a plurality of electrically conductive grids, which are respectively associated with the patterns, each grid is positioned between the anode and the corresponding cathode, is electrically insulated from said cathode and is intended to be positively polarized compared with the latter, and negatively polarized compared with the anode or raised to the potential of the latter.

In certain constructions, the anodes are formed in such a way that they can also function as grids.

According to another embodiment of the unit according to the invention, each anode is placed on a transparent support facing the corresponding cathode.

According to another embodiment, each anode is integrated to the corresponding cathode and is electrically insulated therefrom, the micropoints of each cathode covering the complete surface of the corresponding anode. In other words, the projection of the surface occupied by these micropoints on to the surface occupied by the anode substantially coincides with the latter.

According to another special embodiment, each anode is integrated to the corresponding cathode and is electrically insulated therefrom, the micropoints of each pattern being grouped in the same area separate from the active portion of the anode. In other words, seen from the anode, the area occupied by the micropoints and the cathodoluminescent zone of the anode are separate.

In these two latter embodiments and when the unit according to the invention has the aforementioned grids, each grid can also be integrated to the corresponding cathode and electrically insulated from the corresponding anode.

In this case, or in the case where each anode is placed on a transparent support facing the corresponding cathode, each anode can comprise a layer of a cathodoluminescent substance and an electrically conductive film placed on the latter, facing the corresponding cathode, or an electrically conductive and transparent coating and a coating of a cathodoluminescent substance placed on the latter, facing the corresponding cathode.

In a special embodiment of the invention, each anode can comprise a coating of an electrically conductive, cathodoluminescent substance.

In the two embodiments referred to hereintobefore, corresponding to the case where each anode is integrated to the corresponding cathode, and when the aforementioned grids are used, each grid can also be integrated to the corresponding cathode, each anode then having a cathodoluminescent substance layer raised to the potential of the corresponding grid or to a potential higher than that of the grid, the latter being positive.

In the two special embodiments in question, the unit according to the invention can also comprise a thin, transparent electrode facing the anodes, on a transparent support.

According to an embodiment of the invention using the aforementioned grids, the cathodes are grouped along rows parallel to one another, the cathodes of the same row being electrically interconnected, the grids being grouped along parallel columns and which are perpendicular to the rows, the grids of one column being electrically interconnected and the unit also comprising electronic control means for carrying out a matrix addressing of the rows and columns. When each anode and each grid corresponding thereto are separated by an electrically insulating coating, all the anodes can be electrically interconnected.

Finally, according to another special embodiment corresponding to one or other of the two aforementioned embodiments, in which each anode is integrated to the corresponding cathode, each anode also being both cathodoluminescent and conductive in order to fulfil the function of the grid, or the grids being present and respectively electrically connected to the corresponding anodes, the cathodes are grouped along parallel rows, the cathodes of one row being electrically interconnected, the anodes as well as the grids optionally associated therewith are grouped along parallel columns and which are perpendicular to the rows, the grids of the same column being electrically interconnected, the anodes of a same column being also electrically connected to one another, the unit then also comprising electronic control means for carrying out a matrix addressing of the rows and columns.

The possibility of obtaining the cathodes and grids by an integrated technology makes it possible to produce the unit according to the invention in a simpler way than with the aforementioned known display units.

Moreover, it has been seen that the latter are controlled by using matrix addressing of the anode-grid system. As stated, in certain constructions, the unit according to the invention can be controlled by carrying out a matrix addressing of the cathodes and grids, because the response time of the cathodes in the invention is very fast. This further facilitates the construction of the unit according to the invention as compared with the aforementioned known display units.

DETAILED DESCRIPTION OF THE PREFERRED EMBODIMENTS

Figure 3:
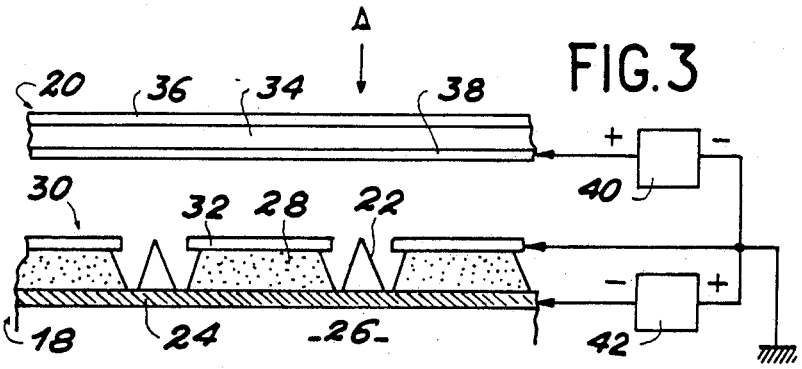
FIG. 3—a diagrammatic view of an embodiment of an elementary pattern provided on the display unit according to the invention.

FIG. 3 diagrammatically shows a special embodiment of the elementary patterns provided on the unit according to the invention. In this embodiment, each elementary pattern comprises a low voltage-excitable cathodoluminescent phosphor coating facing the corresponding cathode, the phosphor coating being observed from the side opposite to its excitation.

More specifically, in the embodiment diagrammatically shown in FIG. 3, each elementary pattern comprises a cathode 18 and a cathodoluminescent anode 20. Cathode 18 comprises a plurality of electrically conductive micropoints 22, formed on an electrically conductive coating 24, which is itself placed on an electrically insulating substrate 26. Coating 24 could be semiconducting instead of being conducting.

The micropoints 22 are separated from one another by electrically insulating coatings 28. Each elementary pattern also comprises a grid 30. The latter is constituted by a plurality of electrically conductive coatings 32 deposited on insulating coatings 28, the latter having substantially the same thickness, said thickness being chosen in such a way that the apex of each micropoint is substantially level with the electrically conductive coatings 32 forming grid 30.

Anode 20 comprises a low voltage-excitable cathodoluminescent phosphor coating 34, deposited on a transparent planar support 36, positioned facing grid 30 parallel thereto, the phosphor coating 34 being deposited on the face of a support directly facing said grid. Anode 20 also comprises an electrically conductive film 38 deposited on the cathodoluminescent phosphor coating 34 and which directly faces grid 30. The latter can be in the form of a continuous coating perforated by holes facing the micropoints. In the same way, the insulating coatings 28 can form a single continuous coating perforated by holes traversed by micropoints.

In a purely indicative and in no way limitative manner, substrate 26 is made from glass and coating 24 is made from aluminium or silicon. Micropoints 22 are made from lanthanum hexaboride or from one of the metals taken from the group including niobium, hafnium, zirconium and molybdenum, or a carbide or nitride of said metals. The phosphorous coating 34 is of zinc sulphide or cadmium sulphide. Transparent support 36 is made from glass, conductive coating 38 is made from aluminium or gold, insulating coatings 28 are made from silica, grid 30 is made from niobium or molybdenum, the micropoints are in the form of cones, whose base diameter is approximately 2 μm and whose height is approximately 1.7 μm. The thickness of each insulating coating 28 is approximately 1.5 μm. The thickness of the grid is approximately 0.4 μm and the holes therein have a diameter of approximately 2 μm. Finally, the conductive film 38 has a thickness of approximately 50 to 100 Å.

In practice, a single glass substrate 26 and a single transparent glass support 36 are used for all the elementary patterns and when the latter are produced in the way shown hereinafter, a vacuum is formed between the anodes and cathodes, the substrate 26 and transparent support 36 being interconnected in a sealing manner.

An elementary pattern is excited by simultaneously polarizing the anode, the grid and the cathode. One of these, e.g. the grid, is used as the reference potential and is earthed. The anode can be raised to the potential of the grid or can be positively polarized relative thereto with the aid of a voltage supply 40. The cathode is negatively polarized compared with the grid using a voltage supply 42.

Each point of the elementary pattern then emits electrons which will excite the phosphor coating, the conductive coating 38 having been made as thin as possible so as not to stop the electrons, the thus excited phosphor coating emitting light which can be observed through the transparent support 36. A low voltage of approximately 100 volts between the grid and the cathode makes it possible to obtain an electronic current of a few microamperes per micropoint and consequently an electronic current density of several milliamperes per square millimeter for the complete pattern which has a very large number of micropoints (several tens of thousands) per square millimeter.

Figure 4:
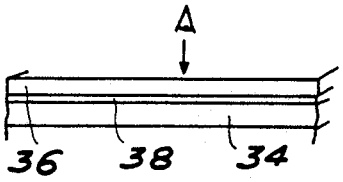
FIGS. 4 and 5—diagrammatic views of special embodiments of cathodoluminescent anodes used in the invention.

In the variant of FIG. 4, the conductive coating no longer faces the micropoints and is instead located between the transparent support 36 and the phosphor coating 34, the latter then directly facing the micropoints 22. In this case, conductive film 38 is chosen so as to be transparent to the light emission of the phosphor. For this purpose, film 38 is e.g. a tin-doped indium oxide coating.

Figure 5:
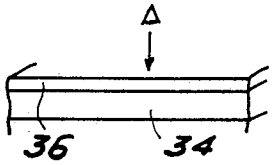

In a further variant according to FIG. 5, conductive film 38 is eliminated and the phosphor coating 34, deposited on the transparent support 36, is then chosen in such a way that it is also electrically conductive. To this end, use is e.g. made of a zinc-doped zinc oxide coating.

In another special embodiment, the phosphor is deposited on the grid (with the possible exception of the interposing of coatings), the assembly formed by the cathode, the grid and the anode then being integrated on to the same substrate and the phosphor being observed from the side where it is excited, which makes it possible to eliminate the light loss due to the passage through the phosphor and which occurs in the embodiments of FIGS. 3, 4 and 5.

Figure 6:
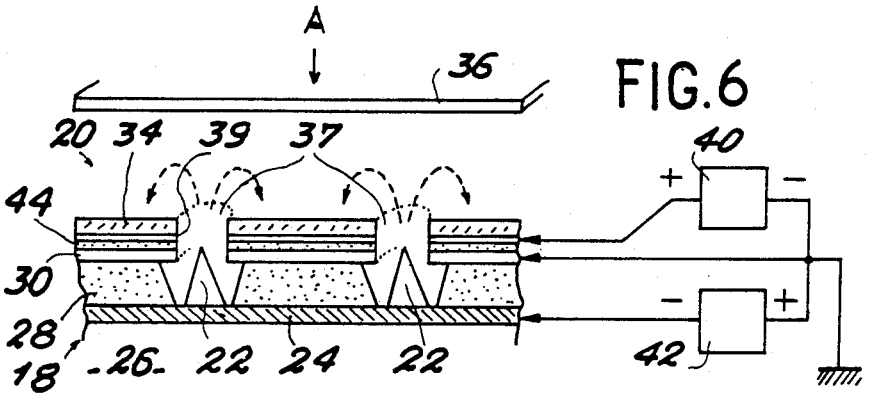
FIGS. 6, 7, 8 and 9—diagrammatic views of other special embodiments of elementary patterns used on the unit according to the invention, in which the cathode, the grid and the anode of the same elementary pattern are integrated on to the same substrate, the anode also serving the function of a grid in the construction according to FIG. 9.

More specifically, in the other embodiment of the elementary patterns diagrammatically represented in FIG. 6, cathode 18 comprises micropoints 22 on the conductive coating 24, the latter being deposited on the insulating substrate 26, the micropoints being separated by electrically insulating coatings 28 on which the grid 30 is deposited.

An electrically insulating coating 44, e.g. of silica is deposited on the grid coating 30 and also has holes corresponding to the holes made in the grid coating, so that the micropoints 22 appear.

Anode 20 comprises an electrically conductive coating 39, e.g. of gold or aluminium, deposited on the insulating coating 44 and a phosphor coating 34 deposited on the conductive coating 39. Obviously these coatings 34 and 39 have holes 37 enabling the micropoints 22 to appear, so that the composite coating resulting from the stacking of coatings 30, 44, 39 and 34 constitutes a coating perforated by holes permitting the appearance of micropoints 22.

Moreover, the micropoints are preferably regularly distributed in such a way that the surface occupied by them substantially coincides with the surface occupied by the phosphor coating and on observing the latter, it appears to be covered by micropoints.

The transparent support 36 is positioned facing the phosphor coating 34, parallel to the latter and is sealingly connected to substrate 26, once the vacuum has been established between them.

As hereinbefore, the anode can be raised to the same potential as the grid, or to a positive potential compared with the latter, by means of a voltage supply 40, whilst the cathode is raised to a negative potential compared with the grid with the aid of a voltage supply 42, the grid being taken as the reference potential and connected to earth.

Under these conditions, each micropoint 22 emits electrons, which pass through the hole corresponding to the micropoint in question and whose path is then curved in the direction of the phosphor coating 34, so that the electrons strike the phosphor coating, which then emits light which can be observed through the transparent support 36.

In a not shown variant, the phosphor coating 34 is directly deposited on the insulating coating 44 and the conductive coating 39 is then deposited on the phosphor coating 34 and is chosen so as to be transparent to the light emitted by said phosphor coating. In another variant diagrammatically shown in FIG. 7, the electrically conductive coating 39 is eliminated and the phosphor coating 34 is directly deposited on the insulating coating 44, the phosphor coating then being chosen so as to be electrically conductive.

Figure 8:
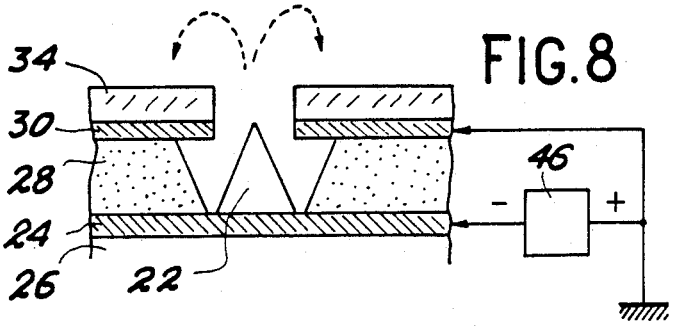

In another variant diagrammatically shown in FIG. 8, the insulating coating 44 is eliminated and the phosphor coating 34 is directly deposited on grid coating 30 and is raised to the potential of the grid, the excitation of the elementary pattern then being carried out by raising the cathode to a negative potential compared with the grid by means of a voltage supply 46, the grid then being earthed.

Figure 9:
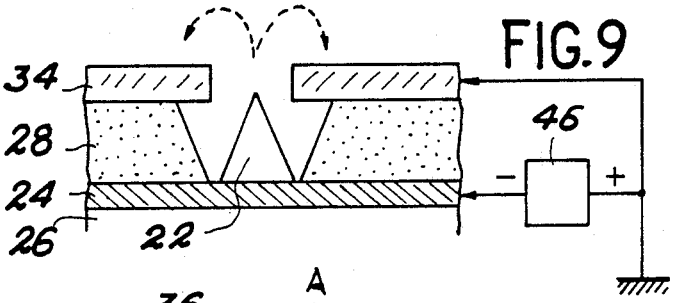

In another variant diagrammatically shown in FIG. 9, the grid is eliminated and the phosphor coating 34, chosen so as to be electrically conductive, also serves as the grid. The cathode is then raised to a negative potential compared with the phosphor coating, which is earthed.

Figure 10:
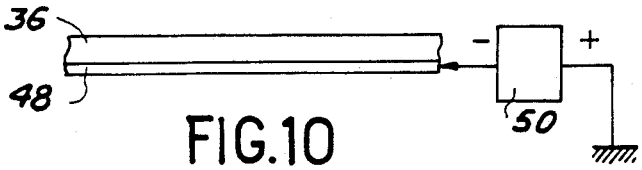
FIG. 10—a diagrammatic view of another special embodiment of the invention using a thin, transparent electrode facing the cathodoluminescent anodes.

In a special embodiment corresponding to the case where the anode and cathode are integrated on to the same substrate, an electrically conductive, transparent coating 48 (FIG. 7) is deposited on the face of the transparent support 36 directly facing anode 20. This conductive, transparent support 48 can be left floating or can be raised to a repulsive potential with respect to the electrons emitted by micropoints 22 by means of a voltage supply 50 (FIG. 10).

Figure 11:
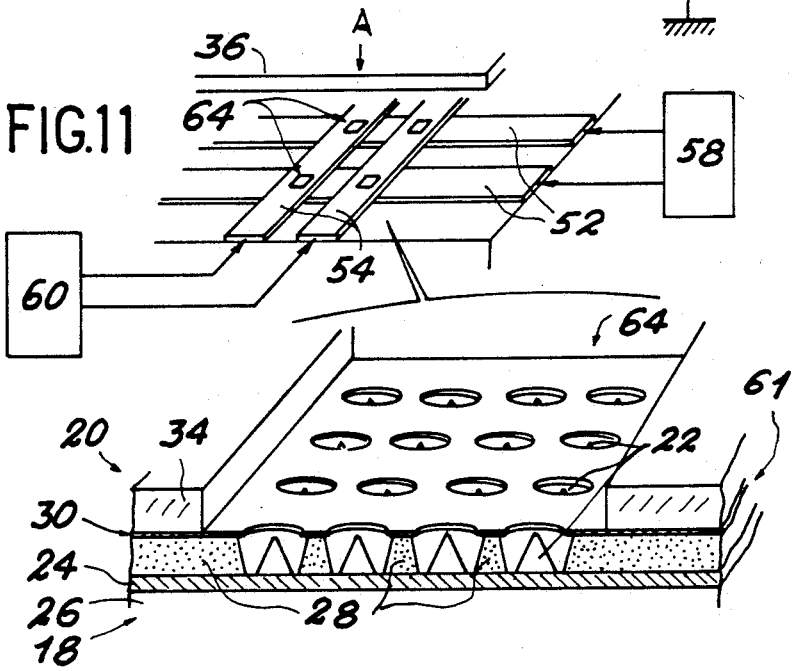
FIG. 11—a diagrammatic view of a special embodiment of the unit according to the invention, in which the micropoints of the same elementary pattern are grouped in the same field or region.

FIG. 11 diagrammatically shows another embodiment of an elementary pattern, the only difference compared with the aforementioned embodiments and corresponding to the case where the anode, grid and cathode are integrated on to the same substrate is that the micropoints 22, observed from above the phosphor coating 34, do not appear to cover the complete coating 34. In the present case, they are brought together in the same region. More specifically, in the embodiment of FIG. 11, the micropoints are located in the same region 64 on conductive coating 24, which is itself deposited on the insulating substrate 26. The insulating coating 28 is deposited on conductive coating 24, whilst separating the micropoints from one another, a grid coating 30 having holes corresponding to the micropoints being deposited on the insulating coating 28 and a phosphor coating 34 is deposited on the grid coating, except above the region in which the micropoints are concentrated and is raised to the same potential as the grid (as explained in the description of FIG. 8).

Figure 7:
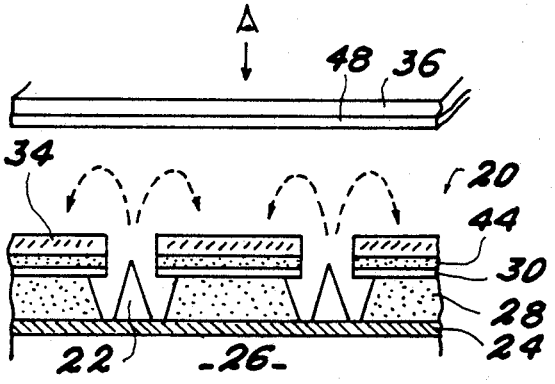

As a variant, it would be possible to deposit a perforated grid coating on the insulating coating 28, followed by another insulating coating on the grid coating, except above said region 64 and finally an optionally composite coating serving as the anode on said other insulating coating, the anode coating being constituted by an electrically conductive coating associated with a phosphor coating (as explained relative to FIG. 6), or simply an electrically conductive phosphor coating (as explained relative to FIG. 7).

According to another variant, it would be possible to deposit on insulating coating 28 an electrically conductive phosphor coating serving both as the anode and the grid and perforated with holes corresponding to the micropoints.

Obviously, the transparent support 36 is still positioned facing the anode and is optionally provided with a conductive coating, left floating or raised to an appropriate potential, as explained hereinbefore.

FIG. 8 diagrammatically shows a special embodiment of a display unit according to the invention in which case the elementary patterns are produced in accordance with the description of FIG. 3, with possible variants described with reference to FIGS. 4 and 5. Furthermore, the cathodes are grouped in accordance with parallel rows 52 and they are formed on the same electrically insulating substrate 26. Moreover, in each row, the cathodes are continuous, i.e. there is no interruption on passing from one cathode to another.

The grids are grouped along parallel columns 54, which are perpendicular to the rows 52. In each column, the grids are continuous, i.e. there is no interruption between adjacent grids. The micropoints serve no useful in any zone corresponding to a gap separating two columns.

Moreover, the anodes form a continuous system constituted by a single phosphor coating 34 associated, when it is not electrically conducting, with a single electrically conducting coating 38, said two coatings being deposited on a single transparent support 36. The characteristics of coating 38 were explained in the description of FIGS. 3 and 4, as a function of the situation of said coating. Thus, each elementary pattern 56 corresponds to the crossing of one row and one column.

Figure 1:
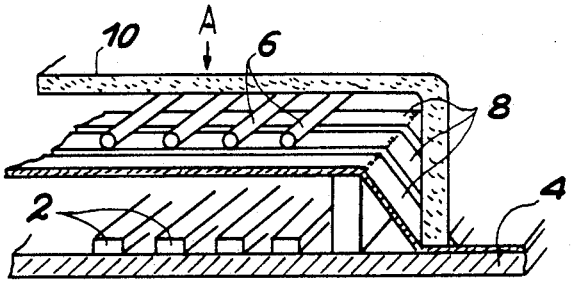
FIG. 1—a diagrammatic view of a known unit for display by cathodoluminescence excited by thermoelectronic emission and already described.
Figure 2:
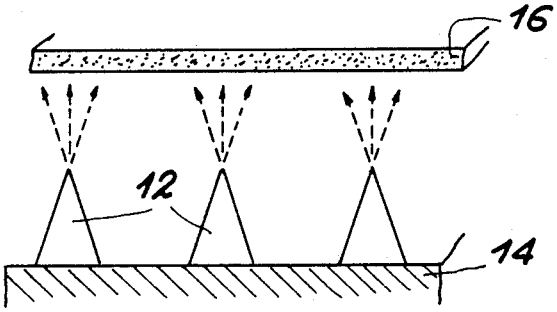
FIG. 2—a diagram illustrating the aforementioned field emission principle.
Figure 12:
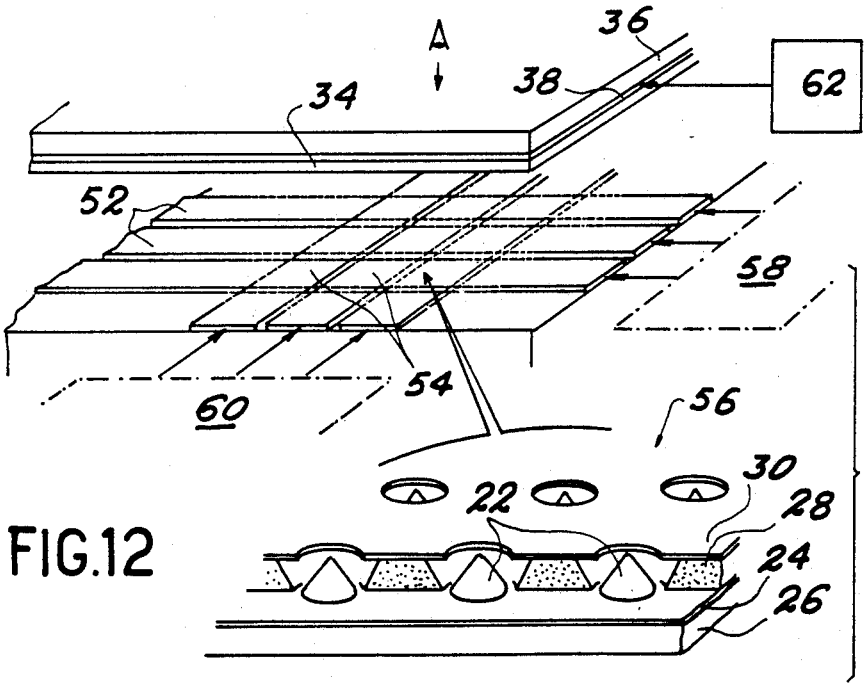
FIG. 12—a diagrammatic view of another special embodiment, in which the micropoints of a same pattern "cover" the complete surface of the corresponding anode.

The display unit shown in FIG. 12 also comprises electronic control means for effecting a matrix addressing of the rows and columns. Such electronic means are known in the art, both in the case where it is wished to obtain stationary pictures and in the case where it is wished to obtain moving pictures.

For each elementary pattern, field emission mainly occurs when a potential difference exceeding a positive threshold voltage $V_S$, is applied between the grid and the cathode of the pattern in question, the anode of the latter being raised to a potential at least equal to that of the grid.

In order to form stationary or moving pictures, the following operations are carried out for the first row, then for the second and so on up to the final row. The row in question is raised to potential $-V/2$, potential V being equal to or higher than $V_S$ and lower than $2V_S$, whilst all the other rows are left floating or are raised to a zero potential, which is carried out with the aid of first means 58 forming part of the electronic means and in a simultaneous manner, all the columns corresponding to the elementary patterns to be excited on the row in question are raised to potential $V/2$, whilst the other columns are left floating or raised to a zero potential, this being carried out with the aid of second means 60 forming part of the electronic means, the anodes being constantly maintained at a potential at least equal to $V/2$ with the aid of an appropriate voltage supply 62.

It is also possible to produce a unit according to the invention by forming the elementary patterns in the manner described relative to FIGS. 6 to 10. In this case, the rows are formed in the manner explained hereinbefore and the anodes, when they are electrically connected to the associated grids or when they act as grids, are arranged along the columns, the anodes of the same column not being separated.

When the anodes and grids are separated by insulating coatings, all the anodes of the unit can be electrically interconnected.

It is then possible to use the same electronic matrix addressing means as those described hereinbefore. In this case, when in each column the anodes have to be electrically insulated from the corresponding grids, said anodes are constantly maintained and a potential at least equal to $V/2$.

Another special embodiment of the unit according to the invention is also shown in FIG. 11. This other embodiment comprises elementary patterns 61, in each of which the micropoints are grouped in the same region 64, as explained hereinbefore with reference to FIG. 11. The cathodes are grouped in parallel rows 52 and the anodes, when they are electrically connected to the associated grids or when they serve as grids, are thus grouped together with any possible grids along columns 54 which are parallel to one another and perpendicular to the rows, as explained hereinbefore. The crossing of a row and a column corresponds to an elementary pattern, in the centre of which said region 64 is located. The display unit of FIG. 11 can be controlled in the same way as the unit described relative to FIG. 12. Obviously, the insulating substrate 26 and the transparent support 36 are common to all the elementary patterns. When the anodes and the grids are separated by insulating coatings, all the anodes of the unit can be electrically interconnected.

The formation of micropoints 22 on a conductive coating 24 and separated by insulating coatings 28 is known in the Art and has been studied by Spindt at the Stanford Research Institute (for applications unrelated with visual displays). For producing the units represented in FIGS. 11 and 12, known microelectronics procedures are used.

What is claimed is:

1. A display unit comprising a plurality of elementary patterns, each pattern having an anode comprising a cathodoluminescent layer and a cathode able to emit electrons, each cathode comprising a plurality of electrically interconnected micropoints subject to an electron emission by field effect when the cathode is negatively polarized relative to the corresponding anode, each anode being integrated onto the corresponding cathode and being electrically insulated therefrom, said anode and its cathodoluminescent layer having openings opposite said micropoints, whereby electons emitted by said micropoints first pass through said openings and thereafter return towards said cathodoluminescent layer and strike that layer around said openings, and further including a plurality of electrically conductive grids, respectively associated with the patterns, each grid being integrated onto a corresponding cathode and being electrically insulated from a corresponding anode by an electrically insulating layer with said cathodoluminescent layer being placed on the insulating layer, and each anode also comprising an electrically conductive transparent layer placed on the cathodoluminescent layer, each grid being disposed between the corresponding cathode and a corresponding anode electrically insulated from said cathode and positively polarized with respect to the latter, and being negatively polarized with respect to the anode or raised to the potential of that anode, and having holes opposite the micropoints.

2. A unit according to claim 1, wherein each anode comprises an electrically conductive layer placed on the insulating layer and wherein said cathodoluminescent layer is placed on the conductive layer.

3. A unit according to claim 1, wherein each cathodoluminescent layer is brought to the potential of the corresponding grid or to a potential higher than that of said grid, the latter being positive.

4. A unit according to claim 3, wherein the cathodes are grouped along parallel rows, the cathodes of the same row being electrically interconnected, wherein the anodes and the grids are grouped along parallel columns, which are perpendicular to the rows, the grids of the same column being electrically interconnected, the anodes of the same column also being electrically interconnected and wherein the unit also comprises electronic control means for effecting matrix addressing of the rows and columns.

5. A unit according to claim 1, wherein said cathodoluminescent layer is directly deposited on the corresponding grid and is raised to the potential of the grid, the excitation of the elementary pattern then being carried out by raising the cathode to a negative potential with respect to the grid, the grid being earthed.

6. A unit according to claim 1, wherein the cathodes are grouped along parallel rows, the cathodes of the same row being electrically interconnected, wherein the grids are grouped along parallel columns and which are perpendicular to the rows, the grids of the same column being electrically interconnected and wherein the unit also comprises electronic control means for effecting a matrix addressing of the rows and columns.

7. A display unit comprising a plurality of elementary patterns, each pattern having an anode comprising a cathodoluminescent layer and a cathode able to emit electrons, each cathode comprising a plurality of electrically interconnected micropoints subject to an electron emission by field effect when the cathode is negatively polarized relative to the corresponding anode, each anode being integrated onto the corresponding cathode and being electrically insulated therefrom, said anode and its cathodoluminescent layer having openings opposite said micropoints, whereby electrons emitted by said micropoints first pass through said openings and thereafter return towards said cathodoluminescent layer and strike the latter around said openings and further including a plurality of electrically conductive grids, respectively associated with the patterns, each grid being integrated onto a corresponding cathode, disposed between that corresponding cathode and a corresponding anode electrically insulated from said cathode and positively polarized with respect to that cathode, and negatively polarized with respect to the anode or raised to the potential of the anode, and having holes opposite the micropoints with each anode including a coating of an electrically conductive, cathodoluminescent substance, wherein the cathodes are grouped along parallel rows, the cathodes of the same row being electrically connected, wherein the anodes and grids are grouped along columns to be parallel to one another and to be perpendicular to the rows, the grids of the same column being electrically interconnected, the anodes of the same column also being electrically interconnected, and wherein the unit also comprises electronic control means for effecting a matrix addressing of the rows and columns.

8. A display unit comprising a plurality of elementary patterns, each pattern having an anode comprising a cathodoluminescent layer and a cathode able to emit electrons, each cathode comprising a plurality of electrically interconnected micropoints subject to an electron emission by field effect when the cathode is negatively polarized relative to the corresponding anode, each anode being integrated onto the corresponding cathode and being electrically insulated therefrom, said anode and its cathodoluminescent layer having openings opposite said micropoints, whereby electrons emitted by said micropoints first pass through said openings and thereafter return towards said cathodoluminescent layer and strike that layer around said openings, and further including a plurality of electrically conductive grids, respectively associated with the patterns, each grid being integrated onto a corresponding cathode and being electrically insulated from a corresponding anode by an electrically insulating layer and wherein each anode includes an electrically conductive layer placed on the insulating layer and wherein said cathodoluminescent layer is placed on the conductive layer, each grid being disposed between the corresponding cathode and a corresponding anode electrically insulated from said cathode and positively polarized with respect to the cathode, and being negatively polarized with respect to the anode or raised to the potential of that anode, and having holes opposite the micropoints.

* * * * *